US008986410B2

(12) United States Patent
Sarangi et al.

(10) Patent No.: US 8,986,410 B2
(45) Date of Patent: Mar. 24, 2015

(54) BONDED ABRASIVE ARTICLE AND METHOD OF FORMING

(71) Applicants: Nilanjan Sarangi, Shrewsbury, MA (US); Sandhya Jayaraman Rukmani, Worcester, MA (US)

(72) Inventors: Nilanjan Sarangi, Shrewsbury, MA (US); Sandhya Jayaraman Rukmani, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/732,231

(22) Filed: Dec. 31, 2012

(65) Prior Publication Data

US 2013/0167448 A1 Jul. 4, 2013

Related U.S. Application Data

(60) Provisional application No. 61/582,049, filed on Dec. 30, 2011.

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |
| ***B24D 3/14*** | (2006.01) |

(52) U.S. Cl.

CPC ..... *B24D 3/14* (2013.01); *B24D 18/0009* (2013.01)

USPC ..... 51/308; 51/293; 51/307; 51/309

(58) Field of Classification Search

USPC ..... 51/308, 293, 307, 309

See application file for complete search history.

(56) References Cited

U.S. PATENT DOCUMENTS

| | | | | |
|---|---|---|---|---|
| 4,150,514 | A | 4/1979 | Douglass | |
| 4,305,898 | A | 12/1981 | Obersby | |
| 4,404,003 | A | 9/1983 | Harris | |
| 4,543,107 | A | 9/1985 | Rue | |
| 4,898,597 | A | 2/1990 | Hay et al. | |
| 4,997,694 | A | 3/1991 | Legare | |
| 5,152,810 | A * | 10/1992 | Rue et al. | 51/309 |
| 5,203,882 | A * | 4/1993 | Carman et al. | 51/293 |
| 5,203,886 | A | 4/1993 | Sheldon et al. | |
| 5,302,564 | A | 4/1994 | Winkler et al. | |
| 5,401,284 | A | 3/1995 | Sheldon et al. | |
| 5,536,283 | A | 7/1996 | Sheldon et al. | |
| 5,653,775 | A | 8/1997 | Plovnick et al. | |
| 5,858,037 | A | 1/1999 | Sukumaran Jayan et al. | |
| 6,277,161 | B1 | 8/2001 | Castro et al. | |
| 6,453,899 | B1 | 9/2002 | Tselesin | |
| 6,702,867 | B2 | 3/2004 | Carman et al. | |
| 6,913,824 | B2 | 7/2005 | Culler et al. | |
| 2003/0029094 | A1 | 2/2003 | Moeltgen et al. | |
| 2004/0221515 | A1 * | 11/2004 | McArdle et al. | 51/308 |
| 2007/0275641 | A1 | 11/2007 | Subramanian et al. | |
| 2011/0131889 | A1 | 6/2011 | Querel et al. | |
| 2012/0055100 | A1 | 3/2012 | Yamazoe et al. | |

FOREIGN PATENT DOCUMENTS

JP 2010-274383 A 12/2010

OTHER PUBLICATIONS

International Search Report for PCT/US2012/072239 dated Apr. 25, 2013, 4 pgs.

* cited by examiner

*Primary Examiner* — James McDonough

(74) *Attorney, Agent, or Firm* — Abel Law Group, LLP; Joseph P. Sullivan

(57) ABSTRACT

A method of forming an abrasive article includes providing a green body having abrasive particles including microcrystalline alumina, and heating the green body via microwave radiation to form a bonded abrasive body including the abrasive particles and a bond material comprising a vitreous phase.

19 Claims, 2 Drawing Sheets

BONDED ABRASIVE ARTICLE AND METHOD OF FORMING

CROSS-REFERENCE TO RELATED APPLICATION

The present application claims priority from U.S. Provisional Patent Application No. 61/582,049 entitled "Bonded Abrasive Article and Method of Forming," by Nilanjan Sarangi and Sandhya Jayaraman Rukmani, filed Dec. 30, 2011, which is incorporated by reference herein in its entirety.

BACKGROUND

1. Field of the Disclosure

The following is directed to abrasive articles, and particularly bonded abrasive articles with a vitreous bond.

2. Description of the Related Art

Abrasive tools are generally formed to have abrasive grains contained within a bond material for material removal applications. Superabrasive grains (e.g., diamond or cubic boron nitride (CBN)) or seeded (or even unseeded) sintered sol gel alumina abrasive grain, also referred to microcrystalline alpha-alumina (MCA) abrasive grain, can be employed in such abrasive tools. The bond material can be organic materials, such as a resin, or an inorganic material, such as a glass or vitrified material. In particular, bonded abrasive tools using a vitrified bond material and containing MCA grains or superabrasive grain are commercially useful for grinding.

Certain bonded abrasive tools, particularly those utilizing a vitrified bond material, require high temperature forming processes, oftentimes on the order of 1100° C. or greater, which can have deleterious effects on abrasive grains of MCA. In fact, it has been recognized that at such elevated temperatures necessary to form the abrasive tool, the bond material can react with the abrasive grains, particularly MCA grains, and damage the integrity of the abrasives, reducing the grain sharpness and performance properties. As a result, the industry has migrated toward reducing the formation temperatures necessary to form the bond material in order to curb the high temperature degradation of the abrasive grains during the forming process.

For example, to reduce the amount of reaction between MCA grain and vitrified bond, U.S. Pat. No. 4,543,107 discloses a bond composition suitable for firing at a temperature as low as about 900° C. In an alternate approach, U.S. Pat. No. 4,898,597 discloses a bond composition comprising at least 40% fritted materials suitable for firing at a temperature as low as about 900° C. Other such bonded abrasive articles utilizing bond materials capable of forming at temperatures below 1000° C., include U.S. Pat. Nos. 5,203,886, 5,401,284, 5,536,283, and 6,702,867. Still, the industry continues to demand improved performance of such bonded abrasive articles.

SUMMARY

According to a first aspect, an abrasive article includes a bonded abrasive body including a bond material comprising a vitreous phase, abrasive particles comprising microcrystalline alumina contained within the bond material, and wherein the bonded abrasive body comprises a density variation of not greater than about 11%, wherein the density variation is defined by the equation $[(Dt-Da)/Dt]\times100\%$, wherein Dt represents a target density of the bonded abrasive body and Da represents an actual density of the bonded abrasive body.

In yet another aspect, a method of forming an abrasive article comprises providing a green body comprising abrasive particles including microcrystalline alumina, and heating the green body via microwave radiation to form a bonded abrasive body including the abrasive particles and a bond material comprising a vitreous phase.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1A:
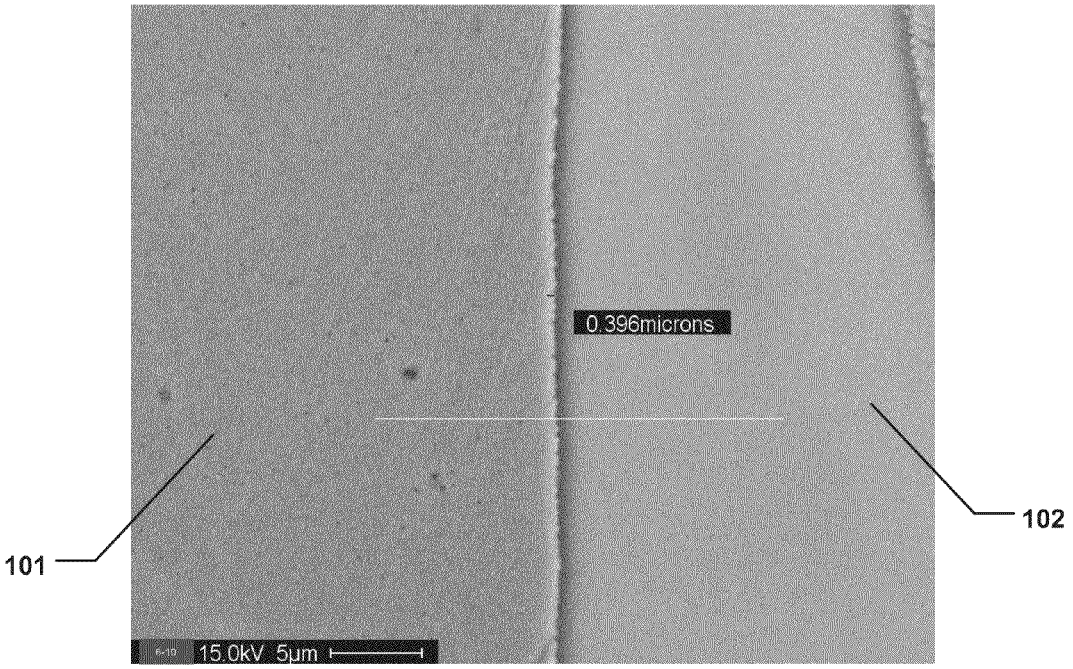
FIGS. 1A and 1B include scanning electron microscope images of a sample according to an embodiment and a comparative sample.

The following is directed to bonded abrasive articles, which may be suitable for grinding and shaping of workpieces. Notably, the bonded abrasive articles of embodiments herein can incorporate abrasive particles within a vitreous bond material. Suitable applications for use of the bonded abrasive articles of the embodiments herein include grinding operations such as, centerless grinding, cylindrical grinding, crankshaft grinding, various surface grinding operations, bearing and gear grinding operations, creepfeed grinding, and various other toolroom applications.

The method of forming a bonded abrasive article according to an embodiment can be initiated by forming a mixture of suitable compounds and components to form a bond material. The bond can be formed of compounds of inorganic material, such as oxide compounds. For example, one suitable oxide material can include silicon dioxide (i.e., silica) ($SiO_2$). In accordance with an embodiment, the bond material can be formed from at least about 48 wt % silica for the total weight of the bond material. Still, in certain embodiments, the bond material may be formed from at least about 50 wt %, such as at least about 52 wt %, on the order of at least about 54 wt %, at least about 56 wt %, or even at least about 58 wt % silicon dioxide for the total weight of the bond material. In at least one non-limiting embodiment, the content of silica can be not greater than about 85 wt %, not greater than about 80 wt %, not greater than about 75 wt %, or even not greater than about 72 wt %. It will be appreciated that the amount of silica can be within a range between any of the minimum and maximum percentages noted above.

The bond material can be formed from a certain content of aluminum oxide ($Al_2O_3$). For example, the bond material can include at least about 8 wt % aluminum oxide for the total weight of the bond material. In other embodiments, the amount of aluminum oxide can be at least about 9 wt %, at least about 10 wt %, or even about 12 wt %. In certain instances, the bond material may include an amount of aluminum oxide that is not greater than about 20 wt %, not greater than about 18 wt %, not greater than about 17 wt %, or even not greater than about 16 wt % for the total weight of the bond. It will be appreciated that the amount of aluminum oxide can be within a range between any of the minimum and maximum percentages noted above.

In certain instances, the bond material can be formed from a particular ratio between the amount of silica, as measured in weight percent, versus the amount of aluminum oxide, as measured in weight percent. For example, the bond material can be formed from a ratio of weight percent silicon dioxide ($SiO_2$) to weight percent aluminum oxide ($Al_2O_3$) [$SiO_2/Al_2O_3$] of at least about 2.5. In accordance with an embodiment, the ratio of silicon dioxide to aluminum oxide can be greater, such as at least about 3 or even at least about 3.2. In one non-limiting embodiment, the ratio can be not greater than about 6, such as not greater than about 5, or even not greater than about 4.8. It will be appreciated that the ratio of silicon dioxide to aluminum oxide can be within a range between any of the minimum and maximum values noted above.

In accordance with another embodiment, the bond material can be formed form a certain content of boron oxide ($B_2O_3$). For example, the bond material can incorporate not greater than about 20 wt % boron oxide for the total weight of the bond material. In other instances, the amount of boron oxide can be less, such as not greater than about 19 wt %, not greater than about 18 wt %, not greater than about 17 wt %, or even not greater than about 16 wt %. Still, the bond material can be formed from at least about 1 wt %, such as at least about 2 wt %, at least about 3 wt %, or even at least about 5 wt % boron oxide for the total weight of the bond material. It will be appreciated that the amount of boron oxide can be within a range between any of the minimum and maximum percentages noted above.

For certain mixtures, the bond material can be formed from a particular ratio between the amount of silica, as measured in weight percent, versus the amount of boron oxide, as measured in weight percent. For example, the bond material can be formed from a ratio of weight percent silicon dioxide ($SiO_2$) to weight percent aluminum oxide ($B_2O_3$) [$SiO_2/B_2O_3$] of at least about 2. In another embodiment, the ratio of silicon dioxide to boron oxide can be greater, such as at least about 3 or even at least about 4. In one non-limiting embodiment, the ratio can be not greater than about 30, such as not greater than about 26, or even not greater than about 23. It will be appreciated that the ratio of silicon dioxide to boron oxide can be within a range between any of the minimum and maximum values noted above.

In accordance with an embodiment, the bond material can be formed from at least one alkali oxide compound ($R_2O$), wherein R represents a metal selected from Group I elements in the Periodic Table of Elements, according to IUPAC, version date 21 Jan. 2011, and available at http://old.iupac.org/reports/periodic_table/. For example, the bond material can be formed from an alkaline oxide compound ($R_2O$) from the group of compounds including lithium oxide ($Li_2O$), sodium oxide ($Na_2O$), potassium oxide ($K_2O$), and cesium oxide ($Cs_2O$), and a combination thereof.

In accordance with an embodiment, the bond material can be formed from a total content of alkali oxide compounds of at least about 3 wt %, such as at least about 4 wt %, at least about 5 wt %, or even at least about 6 wt %. For other bonded abrasive articles according to embodiments herein, the total content of alkali oxide compounds can be not greater than about 18 wt %, not greater than about 17 wt %, not greater than about 16 wt %, not greater than about 15 wt %, or even not greater than about 12 wt %. It will be appreciated that the bond material can be formed from a total content of alkali oxide compounds within a range between any of the minimum and maximum percentages noted above.

In accordance with one particular embodiment, the bond material can be formed from not greater than about 3 individual alkali oxide compounds ($R_2O$) as noted above. In fact, certain bond materials may incorporate not greater than about 2 alkali oxide compounds within the bond material.

Furthermore, the bond material can be formed from a mixture, wherein the individual content of any of the alkali oxide compounds is not greater than one half of the total content (in weight percent) of alkali oxide compounds within the bond material. However, in other instances, the bond can be formed from a mixture, wherein the individual content of any of the alkali oxide compounds is greater than one half of the total content (in weight percent) of alkali oxide compounds within the bond material.

According to a particular bond material, the amount of sodium oxide can be greater than the content (weight percent) of any other alkali oxide compound within the bond material. For example, the amount of sodium oxide can be greater than the amount of lithium oxide or potassium oxide. In more particular instances, the total content of sodium oxide as measured in weight percent can be greater than the sum of the contents of lithium oxide and potassium oxide as measured in weight percent. Furthermore, in one embodiment, the amount of lithium oxide can be greater than the content of potassium oxide. More particularly, the bond material can be formed from a mixture having a ratio of the content of sodium oxide (wt %) to the total content of alkali oxide compounds ($R_2O$) [$Na_2O/R_2O$] of at least about 0.4. For certain other bond materials, the ratio can be greater, such as at least about 0.5 or even at least about 0.6. Still, in one non-limiting embodiment, the ratio can be not greater than about 0.93, such as not greater than about 0.85, or even not greater than about 0.8. It will be appreciated that the ratio of sodium oxide to the total content of alkali oxide compounds within the bond material can be within a range between any of the minimum and maximum values noted above.

The bond material of the embodiments herein can be formed from a mixture having a ratio of the content of aluminum oxide (wt %) to the total content of alkali oxide compounds ($R_2O$) [$Na_2O/R_2O$] of at least about 0.8. In other instances, the ratio can be greater, such as at least about 1, at least about 1.1, or even at least about 1.2. Still, in one non-limiting embodiment, the ratio can be not greater than about 4, such as not greater than about 3, not greater than about 2.8, or even not greater than about 2.4.

The bond material can be formed from a certain amount of alkali earth compounds (RO), wherein R represents an element from Group II from the Periodic Table of Elements, according to IUPAC, version date 21 Jan. 2011, and available at http://old.iupac.org/reports/periodic_table/. For example, the bond material can incorporate alkaline earth oxide compounds such as calcium oxide (CaO), magnesium oxide (MgO), barium oxide (BaO), or even strontium oxide (SrO). In accordance with an embodiment, the bond material can contain a total amount of alkaline earth oxide compounds of not greater than about 15 wt % for the total weight of the bond material. In still other instances, the bond material may contain less alkaline earth oxide compounds, such as on the order of not greater than about 12 wt %, not greater than about 10 wt %, not greater than about 8 wt %, or not greater than about 7 wt %. Still, according to one embodiment, the bond material may be formed from a total content of alkaline earth oxide compounds of at least about 0.5 wt %, such as at least about 0.8 wt %, at least about 1 wt %, or even at least about 1.4 wt % for the total weight of the bond material. It will be appreciated that the amount of alkaline earth oxide compounds within the bond material can be within a range between any of the minimum and maximum percentages noted above.

In accordance with an embodiment, the bond material can be formed from not greater than about 3 different alkaline earth oxide compounds. In fact, the bond material may contain not greater than 2 different alkaline earth oxide compounds. In one particular instance, the bond material can be formed from 2 alkaline earth oxide compounds consisting of calcium oxide and magnesium oxide.

In one embodiment, the bond material can include an amount (wt %) of calcium oxide that is greater than an amount (wt %) of any other alkaline earth oxide compound. For example, the amount of calcium oxide within the bond material can be greater than the amount of magnesium oxide. More particularly, the bond material can be formed from a mixture having a ratio of the content of calcium oxide (wt %) to the total content of alkaline earth oxide compounds (RO) [CaO/RO] of at least about 0.08. For certain other bond materials, the ratio can be greater, such as at least about 0.1, at least about 0.3, at least about 0.5, or even at least about 0.6. Still, in one non-limiting embodiment, the ratio can be not greater than about 5, such as not greater than about 4, or even not greater than about 3.5. It will be appreciated that the ratio of calcium oxide to the total content of alkaline earth oxide compounds within the bond material can be within a range between any of the minimum and maximum values noted above.

The bond material can be formed from a combination of alkali oxide compounds ($R_2O$) and alkaline earth oxide compounds (RO) such that the total content is not greater than about 25 wt % for the total weight of the bond material. In other embodiments, the total content of alkali oxide compounds and alkaline earth oxide compounds within the bond material can be not greater than about 22 wt %, such as not greater than about 20 wt %, or even not greater than about 18 wt %. However, in certain embodiments, the total content of alkali oxide compounds and alkaline earth compounds present within the bond material can be at least about 5 wt %, such as at least about 7 wt %, such as at least about 8 wt %, at least about 9 wt %, or even at least about 10 wt %. It will be appreciated that the bond material can have a total content of alkali oxide compounds and alkaline earth compounds within a range between any of the minimum and maximum percentages noted above.

In accordance with an embodiment, the bond material can be formed such that the total content of alkali oxide compounds ($R_2O$) present within the bond material is greater than the total content of alkaline earth oxide compounds (RO). In one particular bond material, the ratio of total content (in weight percent) of alkali oxide compounds as compared to the total weight percent of alkaline earth oxide compounds ($R_2O$/RO) can beat least about 0.8, such as at least about 1, at least about 1.2, or even at least about 2. Still, in one non-limiting embodiment, the ratio can be not greater than about 15, such as not greater than about 12, or even not greater than about 10. It will be appreciated that the ratio of total content of alkali oxide compounds as compared to the total weight percent of alkaline earth oxide compounds within the bond material can be within a range between any of the minimum and maximum values noted above.

In accordance with an embodiment, the bond material can be formed from not greater than about 3 wt % phosphorous oxide for the total weight of the bond material. In certain other instances, the bond material may contain not greater than about 2.5 wt %, such as not greater than about 2.0 wt %, not greater than about 1.5 wt %, not greater than about 1.0 wt %, not greater than about 0.8 wt %, not greater than about 0.5 wt %, or even not greater than about 0.2 wt % phosphorous oxide for the total weight of the bond material. In fact, in certain instances, the bond material may be essentially free of phosphorous oxide. Suitable contents of phosphorous oxide can facilitate certain characteristics and grinding performance properties as described herein.

In accordance with one embodiment, the bond material can be formed from not greater than a composition comprising not greater than about 1 wt % of certain oxide compounds, including for example, oxide compounds such as $MnO_2$, $ZrSiO_2$, $CoAl_2O_4$, $Fe_2O_3$, $Li_2O$, $TiO_2$, MgO and a combination thereof. In fact, in particular embodiments, the bond material can be essentially free of the above identified oxide compounds.

In addition to the bond materials placed within the mixture, the process of forming the bonded abrasive article can further include the incorporation of a certain type of abrasive particles. In accordance with an embodiment, the abrasive particles can include microcrystalline alumina (MCA). In fact, in certain instances, the abrasive particles can consist essentially of microcrystalline alumina.

The abrasive particles can have an average particle size that is not greater than about 1050 microns. In other embodiments, the average particle size of the abrasive particles can be less, such as on the order of not greater than 800 microns, not greater than about 600 microns, not greater than about 400 microns, not greater than about 250 microns, not greater than about 225 microns, not greater than about 200 microns, not greater than about 175 microns, not greater than about 150 microns, or even not greater than about 100 microns. Still, the average particle size of the abrasive particles can be at least about 1 micron, such as at least 5 microns, at least about 10 microns, at least about 20 microns, at least about 30 microns, or even at least about 50 microns, at least about 60 microns, at least about 70 microns, or even at least about 80 microns. It will be appreciated that the average particle size of the abrasive particles can be in a range between any of the minimum and maximum values noted above.

In further reference to abrasive particles utilizing microcrystalline alumina, it will be appreciated that microcrystalline alumina can be formed of grains having an average grain size that is sub-micron sized. In fact, the average grain size of a microcrystalline alumina can be not greater than about 1 micron, such as not greater than about 0.8 microns, not greater than about 0.5 microns, not greater than about 0.2 microns, not greater than about 0.1 microns, not greater than about 0.08 microns, not greater than about 0.05 microns. Still, the microcrystalline alumina material may have an average grain size of at least about 1 nm, such as at least about 50 nm. It will be appreciated that the average grain size can be within a range between the minimum and maximum values noted above.

Additionally, formation of the mixture, which includes abrasive particles and bond material, can further include the addition of other components, such as fillers, pore formers, and materials suitable for forming the finally-formed bonded abrasive article. Some suitable examples of pore forming materials can include, but are not limited to, bubble alumina, bubble mullite, hollow spheres including hollow glass spheres, hollow ceramic spheres, hollow polymer spheres, polymer or plastic materials, organic compounds, fibrous materials including strands and/or fibers of glass, ceramic, or polymers. Other suitable pore forming materials can include naphthalene, PDB, shells, wood, and the like. In still another embodiment, the filler can include one or more inorganic materials, including for example oxides, and particularly may include crystalline or amorphous phases of zirconia, silica, titania, and a combination thereof.

After the mixture is suitably formed, the mixture can be shaped to form a green body. Some suitable shaping processes can include pressing, casting, extruding, molding, a combinations thereof. In particular instances, the shaping processes can include pressing operations, such as a cold pressing operation. It will appreciated that reference to a green body is reference to a body that can hold its own shape but has yet to undergo heat treatment (e.g., sintering) to increase the density of the body.

After suitably forming the green body, the green body can undergo heating, and particularly a sintering operation. According to one particular embodiment, heating can be accomplished via microwave radiation, such that the green body is microwave-sintered. The microwave radiation used for microwave sintering can utilize a particular energy of radiation, such as electromagnetic radiation having a wavelength within a range between about 1 mm and about 1 m, such as between about 1 cm and about 1 m, or even between about 50 cm and about 500 cm. Moreover, the microwave radiation can have a frequency within a range between about 0.3 GHz and about 300 GHz, and more particularly within a range between about 0.5 GHz and about 100 GHz, such as between about 0.5 GHz and about 50 GHz, or even between about 0.5 GHz and about 10 GHz.

According to one particular embodiment, microwave-sintering of the green body can be completed using particular firing stages to facilitate the formation of a bonded abrasive body having the features described in embodiments herein. For example, the heating process can include a first stage, wherein the green body is heated via microwave radiation at a first firing temperature. The ramp rate of the first stage from the ambient temperature to the first firing temperature can be at least about 2° C./min. In other instances, the ramp rate may be greater, such as at least about 4° C./min, at least about 6° C./min, or even at least about 8° C./min. Still, in one non-limiting embodiment, the first ramp rate is not greater than about 30° C./min. The first ramp rate can be within a range between any of the minimum and maximum rates noted above.

According to one embodiment, wherein the first firing temperature can be at least about 300° C. In other instances, the first firing temperature can be greater, such as at least about 350° C., at least about 400° C., or even at least about 450° C. Yet, in one non-limiting embodiment, the first firing temperature can be not greater than about 700° C., such as not greater than about 600° C. The first firing temperature can be within a range between any of the minimum and maximum rates noted above.

Additionally, for certain firing schedules, the process can include a first stage hold, wherein the green body is held at the first temperature for a first duration. The first duration can be at least about 5 minutes. In still other embodiments, the first duration can be greater, such as at least about 15 minutes or even at least about 20 minutes. Still, in one particular instance, the first duration can be not greater than about 2 hours, such as not greater than about 1 hour. The first duration can be within a range between any of the minimum and maximum rates noted above.

The atmosphere during the first stage may include an ambient atmosphere. Alternatively, the atmosphere may be a reducing atmosphere.

The heating process may include additional stages. For example, heating can include microwave sintering of the body in a second stage at a second firing temperature after completing the first stage. Notably, the second firing temperature can be greater than the first firing temperature. For certain processes, heating from the first firing temperature to the second firing temperature can include heating at a second ramp rate. In some cases, the second ramp rate can be different from the first ramp rate. In still other instances, the second ramp rate may be substantially the same as the first ramp rate. In one embodiment, the ramp rate of the second stage from the first firing temperature to the second firing temperature can be at least about 2° C./min. In other instances, the second ramp rate may be greater, such as at least about 4° C./min, at least about 6° C./min, or even at least about 8° C./min. Still, in one non-limiting embodiment, the second ramp rate can be not greater than about 30° C./min. It will be appreciated that the second ramp rate can be within a range between any of the minimum and maximum rates noted above.

For particular processes of the embodiments herein, the second firing temperature can be greater than the first firing temperature. Moreover, despite the use of microcrystalline alumina, and conventional wisdom in the art, the second firing temperature may be considerably high. For example, the second firing temperature can be at least about 1100° C., such as at least about 1150° C., at least about 1200° C., or even at least about 1220° C. In at least one non-limiting embodiment, the second firing temperature can be not greater than about 1700° C., such as not greater than about 1600° C., not greater than about 1500° C., or even not greater than about 1400° C. It will be appreciated that the second firing temperature can be within a range between any of the minimum and maximum rates noted above.

According to one embodiment, the process of microwave-sintering can include a second stage hold, wherein the body is held at the second firing temperature for a second duration. The second duration may be different than the first duration, and notably, the second duration may be longer than the first duration. For example, the second duration can be at least about 5 minutes. In still other embodiments, the second duration can be greater, such as at least about 15 minutes or even at least about 20 minutes. Still, in one particular instance, the second duration can be not greater than about 2 hours, or even not greater than about 1 hour. The second duration can be within a range between any of the minimum and maximum rates noted above.

The atmosphere during the second stage may utilize the same atmosphere as the first stage. However, for certain processes, the second stage may utilize a different atmosphere than utilized during the first stage. The atmosphere may differ in composition, pressure, and a combination thereof. In one particular embodiment, the second stage can be completed in an ambient atmosphere. In another instance, the second stage may utilize a reducing atmosphere. After completing the second stage, the body may be cooled, providing a finally-formed bonded abrasive body.

For particular embodiments, the process for forming can be conducted such that the body undergoes limited dimensional changes, which can facilitate the formation of improved articles. For example, during microwave-sintering, the body can undergo a volumetric expansion of less than about 12%. The volumetric expansion of the grinding wheel is measured by comparing the initial volume of the article prior to heating and the final volume formed after heating. The volume is calculated using the formula: $\pi*(OD\hat{}2-ID\hat{}2)*thickness$, wherein OD is the outer diameter and ID is the inner diameter. The volumetric expansion can be defined as $[(Vs-Vg)/Vs]\times 100\%$ wherein Vs is the dimension of the body after sintering and Vg is the dimension of the green body before sintering. In other instances, the volumetric expansion can be less, such as less than about 11%, less than about 10%, less than about 9%, less than about 8%, less than about 7%, or even less than about 6%. In one non-limiting embodiment, the volumetric expansion may be at least about 0.01%. It will be appreciated that the volumetric expansion can be within a range between any of the minimum and maximum values noted above.

According to one particular embodiment, the finally-formed bonded abrasive body comprises a bond material having a vitreous phase material. In particular instances, the bond material can be a single phase vitreous material. In fact, in one embodiment, the bond material can consist essentially of a vitreous phase material. Still, it will be appreciated that the bond material may contain a content of crystalline phase material.

The finally-formed bonded abrasive body can have a particular content of bond material, abrasive particles, and porosity. For example, the bonded abrasive body can have a porosity of at least about 10 vol % for the total volume of the bonded abrasive body. In other embodiments, the amount of porosity can be greater such as at least about 15 vol %, such as at least about 20 vol %, at least about 25 vol %, at least about 30 vol %, or even at least about 35 vol % for the total volume of the bonded abrasive body. In one particular embodiment, the bonded abrasive body can have a porosity that is not greater than about 75 vol %, such as not greater than about 70 vol %, or even not greater than about 65 vol %. It will be appreciated that the bonded abrasive body can have a porosity within a range between any of the minimum and maximum percentages noted above.

In accordance with an embodiment, the bonded abrasive body can have at least about 10 vol % abrasive particles for the total volume of the bonded abrasive body. In other embodiments, the total content of abrasive particles can be greater, such as at least about 15 vol %, at least about 20 vol %, at least about 25 vol %, at least about 30 vol %, or even at least about 35 vol %. In accordance with one particular embodiment, the bonded abrasive body can be formed such that it has not greater than about 55 vol % abrasive particles, such as not greater than about 50 vol %, not greater than about 45 vol %, or even not greater than about 40 vol % for the total volume of the bonded abrasive body. It will be appreciated that the content of abrasive particles within the bonded abrasive body can be within a range between any of the minimum and maximum percentages noted above.

In some instances, a portion of the total porosity within the body can be closed porosity, and in fact, a majority of the porosity can be closed porosity. Still, at least a portion of total porosity in the body may be open porosity defining an interconnected network of channels extending through a portion of the volume of the body.

In certain instances, the bonded abrasive body can be formed such that it contains a particular content (vol %) of bond material. For example, the bonded abrasive body can be formed such that it contains at least about 5 vol %, such as at least about 10 vol %, on the order of at least about 12 vol %, at least about 15 vol %, at least about 18 vol %, at least about 20 vol %, at least about 25 vol %, or even at least about 30 vol % bond material for the total volume of the bonded abrasive body. In other instances, the bonded abrasive body can be formed such that it contains not greater than about 60 vol %, such as not greater than about 50 vol %, not greater than about 45 vol %, not greater than about 40 vol %, not greater than about 35 vol %, or even not greater than about 30 vol % bond material for the total volume of the bonded abrasive body. It will be appreciated that the content of bond material within the bonded abrasive body can be within a range between any of the minimum and maximum percentages noted above.

The bond material can have a composition that is substantially the same as the bond material within the mixture. Moreover, the bond materials of the embodiments herein may be considered high-temperature bond systems that may have a particular temperature at which the viscosity is 4 (T log 4). In particular instances, the bond materials of the bonded abrasive bodies may have a viscosity of 4 at a temperature of greater than 1100° C., such as at least about 1150° C., at least about 1200° C., at least about 1220° C., at least about 1250° C., or even at least about 1270° C.

The bonded abrasive bodies of the embodiments herein can have a particularly limited density variation between a target density and actual density, which may facilitate improved bonded abrasive bodies. Notably, a low density variation can be evidence of low volume change during formation, and more particularly, direct evidence of less degradation of the abrasive particles during forming. For example, the bonded abrasive bodies can have a density variation that can be defined by the equation $[(Dt-Da)/Dt]\times 100\%$, wherein Dt represents a target density of the bonded abrasive body and Da represents an actual density of the bonded abrasive body. Actual density is measured from the dimensions of the fired body and the target density is calculated based on the bond and abrasive amounts, their densities and the loss of ignition of bond. The ignition of the bond (i.e., ignition factor) is defined as a function of the mass change of the material before heating and after heating when the volatile substances are allowed to escape and the mass ceases to change. The formulas used to calculate actual and target densities are shown below:

Actual Density $Da$=Weight/Volume

Target Density $Dt$=(1+(Bond %*Bond Ignition Factor))/(1/(Abrasive Density*Vol % Abrasive)

Bond %=(Vol % Bond*(1/(Abrasive Density*Vol % Abrasive))*Bond Density)/(Ignition Factor)

Notably, the bonded abrasive bodies here can have a limited density variation, such as not greater than about 11%. In other particular embodiments, the density variation can be less, such as not greater than about 10%, not greater than about 9%, not greater than about 8%, not greater than about 7%, or even not greater than about 6%. By contrast, the density variation certain bonded abrasive bodies may be at least at least about 1%. It will be appreciated that the density variation of the bonded abrasive body can be within a range between any of the minimum and maximum percentages noted above.

In accordance with one embodiment, the target density of the bonded abrasive body may be greater than about 1.90 g/cm$^3$, such as greater than about 2.00 g/cm$^3$, or even greater than about 2.05 g/cm$^3$. Still, in one non-limiting aspect, the target density of one bonded abrasive body may be not greater than about 3.00 g/cm$^3$, such as not greater than about 2.80 g/cm$^3$. It will be appreciated that the target density of the bonded abrasive body can be within a range between any of the minimum and maximum percentages noted above.

In yet another instance, the bonded abrasive body may have an actual density of greater than about 1.90 g/cm$^3$, such as greater than about 1.95 g/cm$^3$, or even greater than about 2.00 g/cm$^3$. Still, in one non-limiting aspect, the actual density of one bonded abrasive body may be not greater than about 2.90 g/cm$^3$, such as not greater than about 2.80 g/cm$^3$, not greater than about 2.60 g/cm$^3$, or even not greater than about 2.40 g/cm$^3$. It will be appreciated that the actual density of the bonded abrasive body can be within a range between any of the minimum and maximum percentages noted above.

Reference herein to the grinding capabilities of the bonded abrasive body can relate to grinding operations such as centerless grinding, cylindrical grinding, crankshaft grinding, various surface grinding operations, bearing and gear grinding operations, creepfeed grinding, and various toolroom grinding processes. Moreover, suitable workpieces for the grinding operations can include inorganic or organic materials. In particular instances, the workpiece can include a metal, metal alloy, plastic, or natural material. In one embodiment, the workpiece can include a ferrous metal, non-ferrous metal, metal alloy, metal superalloy, and a combination thereof. In another embodiment, the workpiece can include an organic material, including for example, a polymer material. In still other instances, the workpiece may be a natural material, including for example, wood.

EXAMPLES

Three samples of bonded abrasive bodies are made. A first representative sample, S1 according to embodiments herein. A second sample CS1 and third sample CS2 are made according to conventional techniques. Each of the samples, S1, CS1, and CS2 have the same general structure and are made from a mixture comprising 80-90 wt % abrasive particles of microcrystalline alumina, 9-15 wt % bond material. The mixture further included a remainder amount (wt %) of other additives including a binder material of dextrin or animal glue. The composition of the bond is present in Table 1 below.

TABLE 1

| Composition | Wt % |
|---|---|
| SiO2 | 55-60 |
| Al2O3 | 8-12 |
| Na2O, K2O, Li2O | 8-12 |
| CaO, MgO, BaO | 8-10 |
| Fe2O3 + TiO2 | <1 |

For each of the samples, the mixtures are cold pressed to form green bodies having cylindrical shapes. Particular dimensions of the green bodies are measured, including outside diameter (OD), thickness, and hole diameter. Each of the samples is weighed. The green bodies are sintered according to the schedules presented below in Tables 2-4 below. Notably, sample CS1 is sintered according to the firing schedule of Table 2. Sample CS2 is sintered according to the schedule of Table 3, and Sample S1 is microwave-sintered according to the schedule of Table 4. Microwave-sintering of sample S1 was completed using a 2 kW, 2.45 GHz microwave-sintering unit. The microwave-sintering system produces microwaves of a wavelength of approximately 100 cm.

TABLE 2

| Conventional Sintering Schedule of Sample CS1 | |
|---|---|
| Temperature Change | RT-1260C. ° |
| Ramp | 100° C./hr |
| Dwell | 3 hours |
| | Cool to RT |

TABLE 3

| Conventional Schedule of Sample CS2 | |
|---|---|
| Temperature Change State 1 | RT-550C. ° |
| Ramp Rate Stage 1 | 100° C./hr |
| Temperature Change Stage 2 | 550C. °-1260C. ° |
| Ramp Rate Stage 2 | 150° C./hr |
| Dwell | 30 mins |
| | Cool to RT |

TABLE 4

| Microwave sintering schedule of Sample S1 | |
|---|---|
| Temperature Change Stage 1 (300 W) | RT-350C. ° |
| Ramp Rate Stage 1 | 15° C./min |
| Temperature Change Stage 2 (300 W) | 350C°-550C. ° |
| Ramp Rate Stage 2 | 5° C./min |
| Dwell Stage 2 | 30 mins |
| Temperature Change Stage 3 (800 W) | 550C. °-1240C. ° |
| Ramp Rate Stage 3 | 15° C./min |
| Temperature Change Stage 4 (800 W) | 1240C. °-1260C. ° |
| Ramp Rate Stage 4 | 2° C./min |
| Dwell Stage 4 | 30 mins |
| | Cool to RT |

After sintering the green bodies to form bonded abrasive bodies, the same dimensions that were measured on the green bodies are measured again. The weight of each of the samples is also recorded. Table 5 below demonstrates the results. Notably, for sample CS1, 5 representative samples are made and measured. Likewise, for sample CS2, 5 representative samples are made and measured. Also, sample S1 is made 5 times to make five representative samples, which are measured.

TABLE 5

| Sample ID | Final volume | Initial volume | Volumetric Expansion % | Average |
|---|---|---|---|---|
| CS1 | 16.12 | 13.92 | −15.79 | −15.96 |
| | 16.24 | 13.92 | −16.66 | |
| | 16.05 | 13.92 | −15.32 | |
| | 16.15 | 13.92 | −15.99 | |
| | 16.15 | 13.92 | −16.05 | |
| S1 | 14.45 | 13.92 | −3.84 | −5.27 |
| | 14.70 | 13.92 | −5.60 | |
| | 14.80 | 13.92 | −6.31 | |
| | 14.74 | 13.92 | −5.93 | |
| | 14.57 | 13.92 | −4.66 | |
| CS2 | 15.79 | 13.92 | −13.43 | −13.58 |
| | 15.84 | 13.92 | −13.83 | |
| | 15.79 | 13.92 | −13.43 | |
| | 15.83 | 13.92 | −13.70 | |
| | 15.80 | 13.92 | −13.50 | |

As illustrated in Table 5, samples CS1 and CS2 demonstrated significantly greater expansion during processing. In fact, based on the average OD of the 5 representative samples of CS1, the volumetric expansion of the article in OD is 16%. The volumetric expansion based on change in OD of samples CS2 is 13.6%. Notably, the volumetric change in OD of sample S1 is 5.2%. Moreover, sample CS1 has a density variation of 15.8% based on the target density of 1.257 g/cm$^3$ and an average density of the 5 representative samples is 1.817 g/cm$^3$. Sample CS2 has a density variation of 12.7% based on the target density of 1.257 g/cm$^3$ and an average density of the 5 representative samples of 1.883 g/cm$^3$. Sample S1 has a density variation of 6.3% based on the target density of 1.257 g/cm$^3$ and an average density of the 4 representative samples of 2.021 g/cm$^3$. Quite unexpectedly, despite sample S1 having the same dwell time at the peak temperature (i.e., 1260° C.) as sample CS2, the density variation of sample S1 is remarkably improved in comparison to sample CS2. In fact, sample S1 has a density variation of 50% less than the sample CS2. Without wishing to be tied to a particular theory, it is thought that the particulars of the process facilitate limited degradation of the abrasive grains, which is typically associated with a volume increase and increased density variation.

Figure 1B:
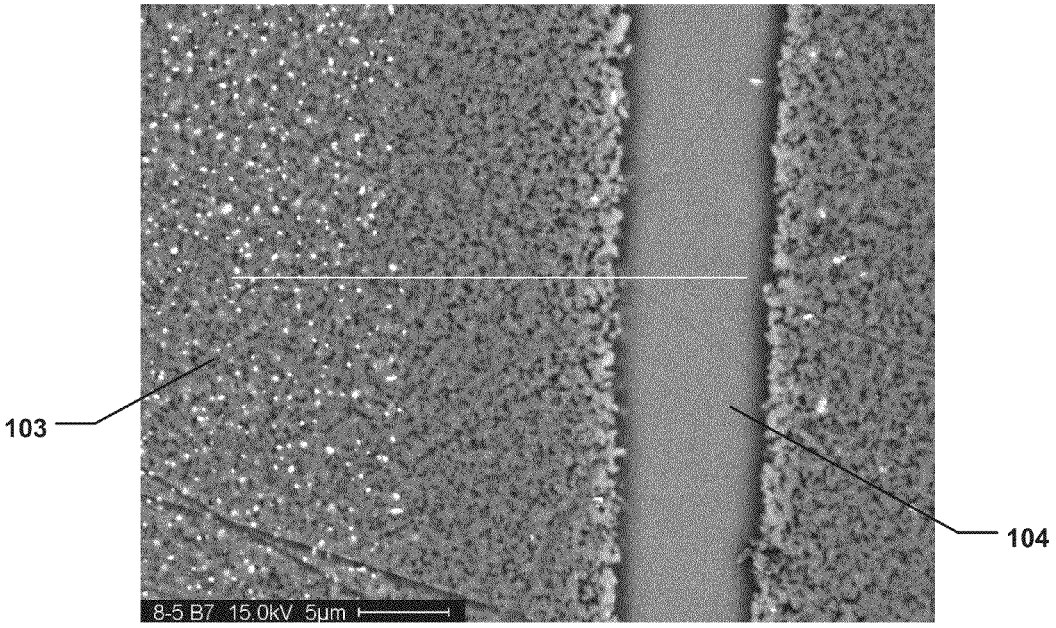

FIGS. 1A and 1B include scanning electron microscope images of samples S1 and CS2, respectively. Notably, FIG.

1A includes a SEM image at 2500× magnification of an interface between a microcrystalline alumina particle 101 and the bond material 102 for sample S1. FIG. 1B includes a SEM image at 2500× magnification of an interface between a microcrystalline alumina particle 103 and the bond material 104 for sample CS2. Notably, in a comparison of the FIGS. 1A and 1B, it is evident that the interface of the microcrystalline alumina particle 102 of sample S1 has a sharper edge and less degradation at the interface between the bond material 102 and particle 101. By contrast, the interface of the microcrystalline alumina particle 103 and bond material 104 of sample CS2 demonstrates significant pitting and irregularities indicating significantly greater degradation of the particle 103 during forming.

Figure 2A:
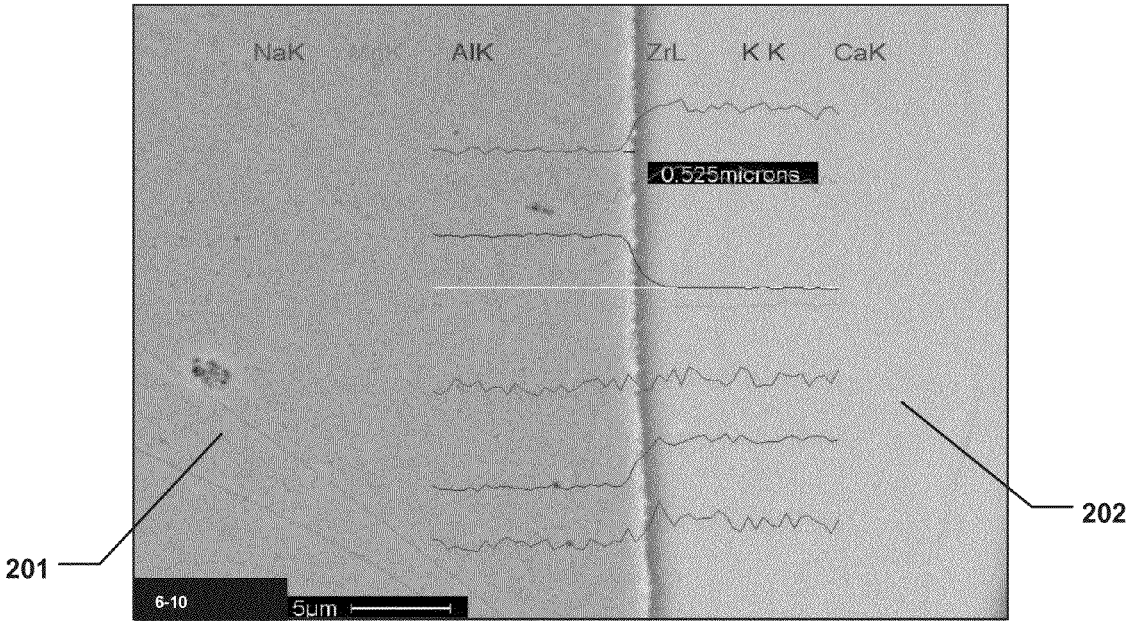
FIGS. 2A and 2B include SEM images of a sample according to an embodiment and a comparative sample The use of the same reference symbols in different drawings indicates similar or identical items.
Figure 2B:
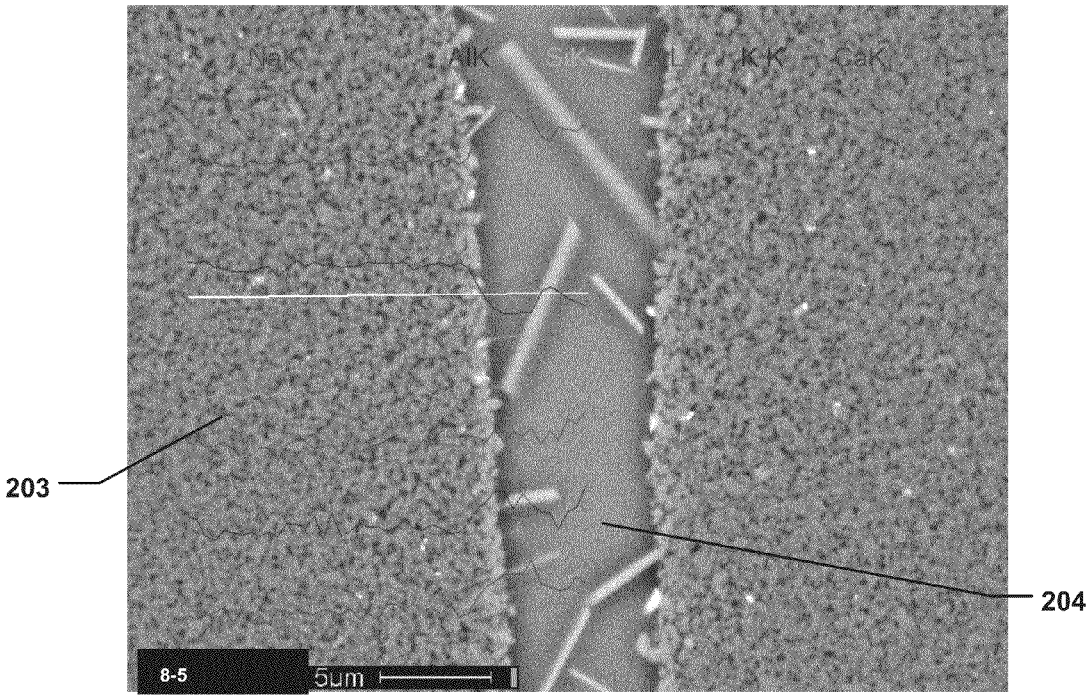

FIGS. 2A and 2B include SEM images of samples S1 and CS2, respectively. In particular, FIG. 2A includes a SEM image at 2500× magnification of an interface between a microcrystalline alumina particle 201 and the bond material 202 for sample S1. FIG. 2B includes a SEM image at 2500× magnification of an interface between a microcrystalline alumina particle 203 and the bond material 204 for sample CS2. Notably, the interfaces illustrated in FIGS. 2A and 2B were analyzed via energy dispersive X-ray analysis (EDS). EDS line scans are performed along the white line indicated in the figures. An accelerating voltage of 15 kV is applied to record the line scan at 2500×. The line scan collects about data on 60 points and at each point the dwell time is about 250 milliseconds. In sample CS2, there is a greater concentration of silica and some alkalis, alkaline earth elements (K, Ca, Na) at the interface. However sample S1 demonstrated significantly less concentration of silica, alkali, and alkaline earth elements at the interface compared to sample CS2. The analysis reveals that sample CS2 demonstrates significantly greater degradation of the particle 203 as compared to the particle 201 during forming.

Estimation on the grain composition was done by performing single point grit analysis by the microprobe analysis using an SX50 machine available as from CAMECA Corporation. An average of at least 6 analytical points in the center and the rim of the grains were used for these measurements. The results of the scan are summarized in Table 6 below.

TABLE 6

| Composition | S1 | CS2 |
|---|---|---|
| B2O3 | 0.86 | 1.16 |
| Na2O | 0.06 | 0.43 |
| MgO | 0.99 | 0.82 |
| Al2O3 | 99.8 | 95.34 |
| SiO2 | 0.49 | 3.25 |
| P2O5 | 0 | 0.01 |
| K2O | 0.02 | 0.09 |
| CaO | 0.04 | 0.18 |
| TiO2 | 0.07 | 0.1 |
| Fe2O3 | 0.01 | 0.03 |
| ZnO | 0.03 | 0.02 |
| ZrO2 | 0.29 | 0.81 |
| BaO | 0.01 | 0 |

As is evident from the microprobe analysis, sample S1 contains a significantly different amount of sodium oxide, silica, and alumina, as compared to sample CS2. The microprobe analysis reveals that sample CS2 demonstrates significantly greater degradation of the particle 203 as compared to the particle 201 during forming.

The foregoing embodiments are directed to abrasive products, and particularly bonded abrasive products, which represent a departure from the state-of-the-art. The bonded abrasive products of the embodiments herein utilize a combination of process techniques that facilitate improved bonded abrasive articles and potentially improved performance. While the effects of the particular processing techniques of the embodiments herein are not completely understood, it was surprisingly revealed that even during a comparison of firing schedules of equal dwell times as peak temperatures between a conventional approach and the approach described herein, the processes described herein facilitated formation of improved bonded abrasive articles. Moreover, such effects are particularly relevant in combination with the compositions and structure of the bonded abrasive bodies described herein.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. A method of forming an abrasive article comprising:

providing a green body comprising abrasive particles including microcrystalline alumina; and heating the green body via microwave radiation to form a bonded abrasive body including the abrasive particles and a bond material comprising a vitreous phase, wherein after heating the bonded abrasive body comprises a density variation of not greater than 11%, wherein the density variation is defined by the equation $[(Dt-Da)/Dt]\times 100\%$, wherein Dt represents a target density of the bonded abrasive body and Da represents an acual density of the bonded abrasive body.

2. The method of claim 1, wherein heating the green body comprises applying microwave radiation having a wavelength within a range between about 1 mm and about 1 m.

3. The method of claim 1, wherein the microwave radiation comprises a frequency of at least about 0.3 GHz and not greater than about 300 GHz.

4. The method of claim 1, wherein heating comprises heating the green body in a first stage to a first firing temperature of at least about 300° C. at a first ramp rate of at least about 2° C/min and not greater than about 30° C/min.

5. The method of claim 4, wherein heating further comprises heating the green body to a second stage at a second firing temperature after heating to the first stage, and wherein the second firing temperature is greater than the first firing temperature, and further wherein heating to the second stage comprises heating at a second ramp rate of least about 2° C/min and not greater than about 30° C/min.

6. The method of claim 5, wherein the second firing temperature is at least about 800° C. and not greater than about 1700° C.

7. The method of claim 1, wherein during firing the green body undergoes a volumetric expansion of less than about 12%.

8. An abrasive article comprising:

a bonded abrasive body formed by microwave radiation including:

a bond material comprising a vitreous phase;

abrasive particles comprising microcrystalline alumina contained within the bond material; and wherein the bonded abrasive body comprises a density variation of not greater than about 11%, wherein the density variation is defined by the equation [(Dt−Da)/Dt]×100%, wherein Dt represents a target density of the bonded abrasive body and Da represents an actual density of the bonded abrasive body.

9. The abrasive article of claim 8, wherein the abrasive particles comprise microcrystalline alumina having an average grain size of not greater than about 1 micron.

10. The abrasive article of claim 8, wherein the bond material is formed from not greater than about 20 wt % boron oxide ($B_2O_3$) for the total weight of the bond material.

11. The abrasive article of claim 8, wherein the bond material is formed from not greater than about 85 wt % silicon dioxide ($SiO_2$) for the total weight of the bond material.

12. The abrasive article of claim 8, wherein the bond material is formed from a ratio of weight percent silicon dioxide ($SiO_2$) to weight percent boron oxide ($B_2O_3$) [$SiO_2/B_2O_3$] of at least about 2 and not greater than about 30.

13. The abrasive article of claim 8, wherein the bond material is formed from a ratio of weight percent silicon dioxide ($SiO_2$) to weight percent aluminum oxide ($Al_2O_3$) [$SiO_2/Al_2O_3$] of at least about 2.5, and not greater than about 6.

14. The abrasive article of claim 8, wherein the bond material is formed from at least one alkali oxide compound ($R_2O$) selected from the group of compounds consisting of lithium oxide ($Li_2O$), sodium oxide ($Na_2O$), potassium oxide ($K_2O$), and cesium oxide ($Cs_2O$) and a combination thereof, and wherein the bond material comprises a ratio of weight percent aluminum oxide ($Al_2O_3$) to weight percent of total alkali oxide compounds within the bond ($R_2O$) [$Al_2O_3/R_2O$] of at least about 0.8 and not greater than about 4.

15. The abrasive article of claim 8, wherein the bond material is formed from at least one alkali oxide compound ($R_2O$) selected from the group of compounds consisting of lithium oxide ($Li_2O$), sodium oxide ($Na_2O$), potassium oxide ($K_2O$), and cesium oxide ($Cs_2O$) and a combination thereof, wherein the bond material is formed from a total amount of alkali oxide compound ($R_2O$) of at least about 3 wt % for the total weight of the bond material, and further wherein the bond material is formed from a content of sodium oxide ($Na_2O$) greater than a content of any other alkali oxide compound.

16. The abrasive article of claim 8, wherein the bond material is formed from a total content of alkali oxide compound ($R_2O$) that is greater than a total content of alkaline earth oxide compounds (RO), and wherein the bond material is formed from a ratio of a total content (weight percent) of alkali oxide compounds ($R_2O$) to a total content (weight percent) of alkaline earth oxide compounds (RO), [$R_2O$/RO] of at least about 0.8 and not greater than about 15.

17. The abrasive article of claim 8, wherein the bond material is formed from not greater than about 3 wt % phosphorous oxide ($P_2O_5$) for the total weight of the bond material.

18. The abrasive article of claim 8, wherein the bond is formed from a composition comprising not greater than about 1 wt % of oxide compounds selected from the group consisting of $MnO_2$, $ZrSiO_2$, $CoAl_2O_4$, $Fe_2O_3$, $Li_2O$, $TiO_2$, and MgO.

19. The abrasive article of claim 8, wherein the bonded abrasive body is sintered at a temperature of greater than about 1100° C.

* * * * *